United States Patent [19]

Dixon et al.

[11] 4,106,544

[45] Aug. 15, 1978

[54] ELECTRICALLY OPERATED FOLDING PARTITION

[75] Inventors: Guy E. Dixon, Miami; Thomas M. Dixon, Hollywood, both of Fla.

[73] Assignee: Panelfold, Inc., Miami, Fla.

[21] Appl. No.: 835,024

[22] Filed: Sep. 20, 1977

[51] Int. Cl.[2] ..... E05D 15/26

[52] U.S. Cl. ..... 160/199; 160/206

[58] Field of Search ..... 160/199, 206, 118, 35

[56] References Cited

U.S. PATENT DOCUMENTS

| | | | |
|---|---|---|---|
| 3,374,821 | 3/1968 | White | 160/206 X |
| 3,389,741 | 6/1968 | Bean | 160/199 |
| 3,448,786 | 6/1969 | Edgerton, Jr. | 160/206 X |

*Primary Examiner*—Philip C. Kannan

*Attorney, Agent, or Firm*—Clarence A. O'Brien; Harvey B. Jacobson

[57] ABSTRACT

An electrically operated folding partition including a plurality of pivotally interconnected panels movable from a straight line, flat, closed and locked position to an accordion folded stacked open position in which the control system will automatically move the partition panels from their closed position to their open position or from their open position to their closed position upon actuation of a suitable control switch or the like. The panels are pivotally interconnected by hinge structures with the hinge axes being disposed at opposite surfaces of the partition to enable accordion folding movement of the panels with the capability of the partition to be extended to a length greater than the length thereof when in fully closed position being used to "break" the panels from their flat, straight line position to a shallow accordion fold position with the hinge axes in a straight line at which point the movement of the endmost panel is reversed and inertia forces causing movement of the panels so the hinge axes cross over their straight line position. When moving the panels to closed position, the outermost panel is moved to a position with the hinge axes in alignment in which position the over-all length of the partition is greater than when the panels are in their flat straight line closed position with the outermost panel then being reversed so that inertia carries the hinge axes across their straight line position.

15 Claims, 10 Drawing Figures

10
12
12'
14
16
18
22
24
26
28
30
32
34
36
38
40

10
22
40
26
28
28
32
34
36
38

10
18
24
26
30

10
14
26
32

10
12'
22
36
38
12
22
12
26
30
12
18
40
32
34
16

ELECTRICALLY OPERATED FOLDING PARTITION

BACKGROUND OF THE INVENTION

1. Field of the Invention

The present invention generally relates to an electrically operated folding partition, hinged wall system, or the like, including a plurality of rigid panels accordion folded for movement between closed and open positions with the panels being supported by a longitudinal track, or the like, and provided with a control arrangement so that the panels will be automatically positioned in a straight line, flat condition when in their fully closed position and automatically moved to their folded, stacked position when in their fully open position with the operation of the panels being in response to an appropriate control switch, or the like, thereby eliminating manual initial movement of the panels to "break" the panels from their straight line, flat fully closed position when they are to be moved to an open position and eliminating manual final movement of the panels into a straight line, flat condition when being moved to a fully closed position.

2. Description of the Prior Art

Folding partitions, wall systems, and the like, supported from longitudinal trackways with the panels being continuously hingedly connected for accordion folding movement between open and closed positions have been known for many years. With the advent of relatively large panels, nominally 2 to 6 feet in width and 2 to 6 inches in thickness and up to 25 to 30 feet in heighth, considerable effort is necessary to manually open and close a partition resulting in the provision of power operated between a fully open and a fully closed position. However, even with such power operated devices, it was necessary for the adjacent panels to be manually moved into their final straight line fully closed position and manually moved out of their flat, straight line fully closed position due to the hinge axes, located on opposite surfaces of the partition, having to pass through a straight line position. It thus was necessary to initially manually move the panels to and from their straight line position with the hinge axes on opposite surfaces of the partition in order for the entire partition to be positioned in the fully closed position to form a flat wall surface or to be accordion folded to open condition.

SUMMARY OF THE INVENTION

It is an object of the present invention to provide an electrically operated folding partition in which the pivotally connected panels are automatically moved to and from their fully closed, flat, straight line locked position without any manual operation of the panels themselves.

Another object of the invention is to provide a folding partition in accordance with the preceding object in which the panels are highedly connected by hinges having their hinge axes at opposite surfaces of the partition so that the panels may accordion fold between an open, center stacked relationship and an extended position with the panels aligned without manual initial or final movement of the panels.

A further important object of the invention is to provide an electrically operated folding partition in accordance with the preceding objects in which the difference in the over-all length of the panels when in their straight, flat, fully closed position and their longer length when the hinge axes between the panels are disposed in alignment is used in combination with a control system for the power means which includes a reversible electric motor to automatically move the panels from a flat, straight line closed position to a center stacked open position and from the open position to the closed position in a simple but yet effective and dependable manner.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1A, 1B, 1C, 1D:
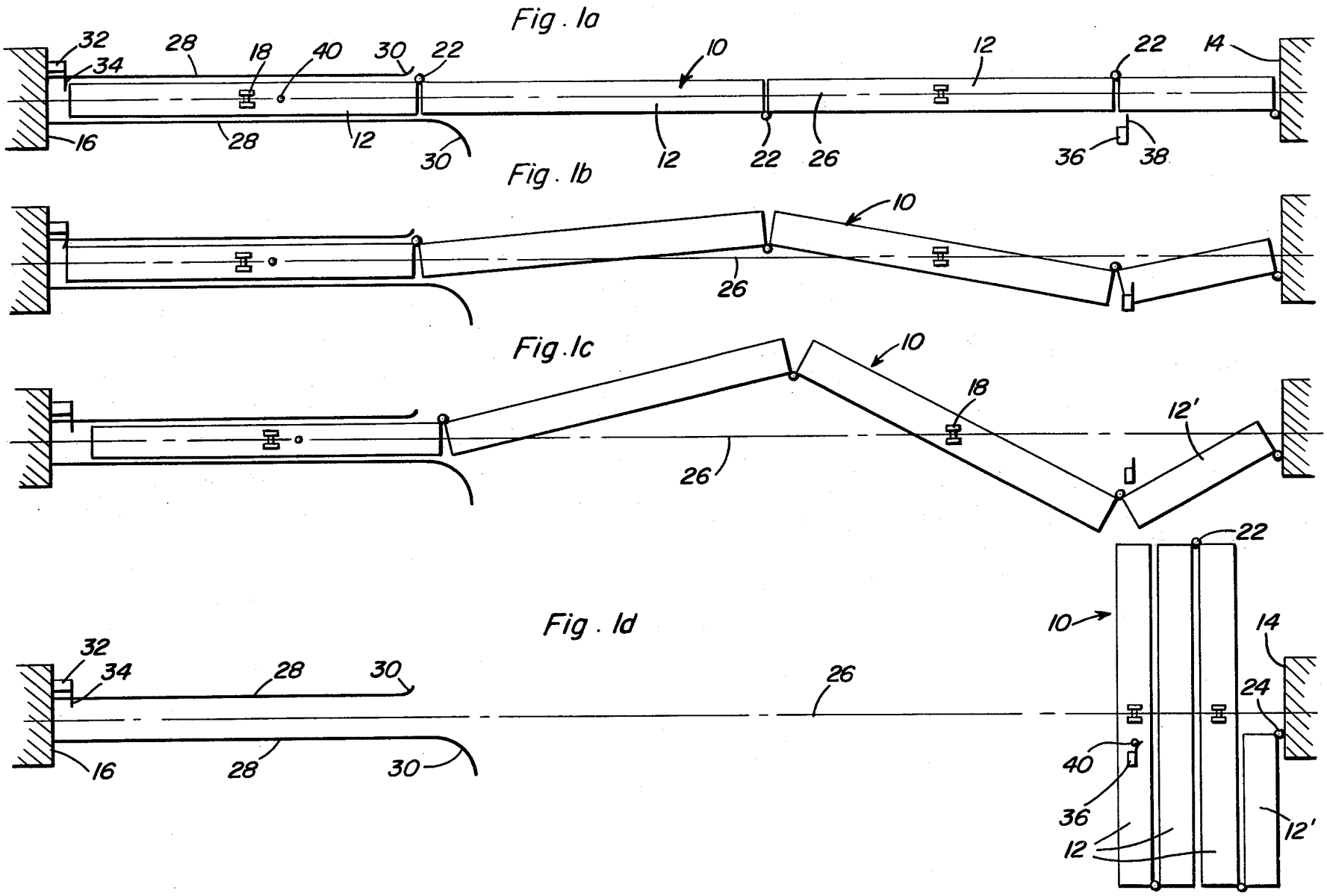
FIGS. 1*a*–1*d* schematically illustrate the movement of the panels from their fully closed position to their fully open position.

Referring now specifically to the drawings, the folding partition is generally designated by numeral 10 and includes a plurality of pivotally connected rigid panels 12 with one of the panels being a half panel 12' and pivotally connected to a jamb 14 defining an opening to be closed by the partition 10 with the opposite edge of the opening being defined by a jamb 16 which is engaged by the free edge of the outermost panel 12. The panels 12 are conventional in construction and may be constructed of various materials with the thickness of such panels nominally being 2 to 3 inches and the width of the panels 12 nominally being 4 feet, although these dimensions may obviously vary. Also, the height of the panels may vary depending upon the ceiling height or position of an overhead supporting trackway (not shown) which is engaged by supporting carriages 18 in a conventional and well known manner. The panels 12 have end edges, which provide an interlocking and sealing construction with the side stiles of the panels being illustrated only in FIG. 3 with the double channel configuration of the stiles 20 providing for stability and rigidity of the adjacent panels when they are in their fully closed, locked position. The stiles are hingedly connected at opposite surfaces of the panels by hinges 22 with the hinge axes being vertical and a similar hinge 24 interconnects the half panel 12' to the jamb 14 with all the hinge axes being disposed laterally of the center line of the supporting trackway and the line of movement of the carriages 18 a distance approximately one-half of the thickness of the panels so that the center line of the half panel 12' will be aligned with the center line of movement of the carriages 18 and in alignment with the center of the partition when in fully closed position as illustrated in FIG. 1*a*. The center line of the partition and the center line of movement of the carriages 18 and the center line of the trackway is schematically illustrated by a broken line and designated by reference numeral 26. Optional spaced guide rails 28 are provided at the top of the opening at the jamb 16 with the guide plates extending most of the distance between the jambs and having outwardly curved or flared free ends 30 with one guide plate 28 being slightly longer than the other. The guide rails 28 may vary in length and extend to a position where the endmost panel 12 will engage the flared end 30 as it leaves the stacked position and moves toward the FIG. 2*a* position. A sensor switch 32 is mounted on the jamb 16 in any suitable manner with a sensing finger 34 extending into the path of movement of the endmost panel 12. A sensor switch 36 having a finger 38 is positioned and supported in any suitable manner adjacent the jamb 14 but in a position for engagement by a projection 40 on the end-most panel 12 to stop the folding partition in its stacked fully open position with the sensor 36 also resetting the control means for the next closing cycle. While a side closing arrangement is illustrated, a center closing partition or any other arrangement of panels may be used with this invention.

FIG. 1*a* illustrates the partition 10 in fully closed position in which the panels 12 are disposed in flat, aligned and locked condition with the center of the panels being coincident to the center line of the track and the center line of the path of movement of the carriages 18. In this position, the partition provides a flat wall forming a complete closure of the open area between the jambs 14 and 16. By constructing the panels with rigid stiles and rails of aluminum, or the like, with the vertical stiles interlocking with each other to form an effective, sound, light and air seal, the wall may be used for various functional purposes. For example, chalk boards, tack boards, or other working surfaces may be provided throughout the full width or length or in any part of the surfaces of the panels. Inset pass through doors or windows may be provided in the panels depending upon the requirements of each installation. FIG. 1*d* illustrates the fully open position of the partition 10 in which the panels are center stacked in a compact and neat condition. While a center stacked arrangement is illustrated, the panels may be side stacked, angle stacked or stacked in any orientation when in open position.

The endmost panel 12 or any of the other panels is connected by any suitable means to a reversible motor with the motor being connected through a cable drive or the like, to the carriage 18 on the endmost panel 12. Assuming that the partition 10 is in the fully closed position with the panels 12 flat and in alignment with each other as illustrated in FIG. 1*a*, upon actuation of a control switch to the "open" position, the motor is initially actuated in a "close" direction so that the endmost panel 12 will be moved toward the jamb 16 so that it will assume a position illustrated in FIG. 1*b*. This elongation of the effective length of the partition will cause the hinge axes defined by the hinges 22 on opposite surfaces of the partition 10 to move toward the center line 26 since a tension force or pulling force is exerted on the endmost panel 12. This "breaks" the panels 12 from their straight line position to a shallow accordion fold. As the endmost panel 12 moves to the extended position, that is, toward the position of FIG. 1*b*, a time delay relay energized previously by the "open" control switch, after a predetermined short time setting, deenergizes the motor and reverses the motor at exactly the right moment in time, causing the motor to run in the "open" direction and continue to move the panels 12 toward their accordion folded open position. The initial movement of the panels 12 from their straight line position toward the position illustrated in FIG. 1*b* will bring the hinge axes 22 initially toward the center line 26 and inertia of the moving panels will carry the hinge axes 22 to the opposite sides of the center line 26 as the motor is being substantially instantaneously reversed so that the hinge axes 22 will cross over the center line as illustrated initially in FIG. 1*b* and continue to move in this direction as illustrated in FIG. 1*c* as the motor continues to operate in the "open" direction. When the partition reaches the fully open position, the projection 40 will contact the finger 38 on the sensor 36 which deenergizes the motor thus stopping the folding partition in the position and resets the switch so that the partition is conditioned for the next closing cycle.

FIGS. 2*a*–2*d* illustrate the closing operation of the partition. Upon activation of the control switch to the "close" position, the motor is energized in the "close" direction. As the panels approach a shallow accordion position, the hinge axes 22 approach the center line 26 so that as the end edge of the endmost panel 12 contacts the finger 34 of the sensor 32, the hinge axes 22 approach and cross over the center line 26 due to inertia forces and the sensor 32 deenergizes the motor and reverses the motor and runs it in the "open" direction for a predetermined short time setting of a time delay relay so that the over-all length of the partition is reduced by moving the panel 12 a very short distance in the "open" direction, thereby enabling the shortening of the over-all length of the partition, thus moving the hinge axes 22 completely to the position illustrated in FIG. 2*d* with the center line of the panels 12 coinciding with the center line 26.

In both the opening and closing of the partition, the movement of the hinge axes is power operated toward the center line 26 and as the hinge axes approach the center line 26, power is disconnected from the endmost panel 12 so that inertial forces carry the hinge axes 22 across the center line 26 after which power is then again applied to the endmost panel 12 but in the opposite direction so that the hinge axes 22 will continue to move away from the center line 26 which they have just crossed over toward either the fully closed or fully open position.

Figure 4:
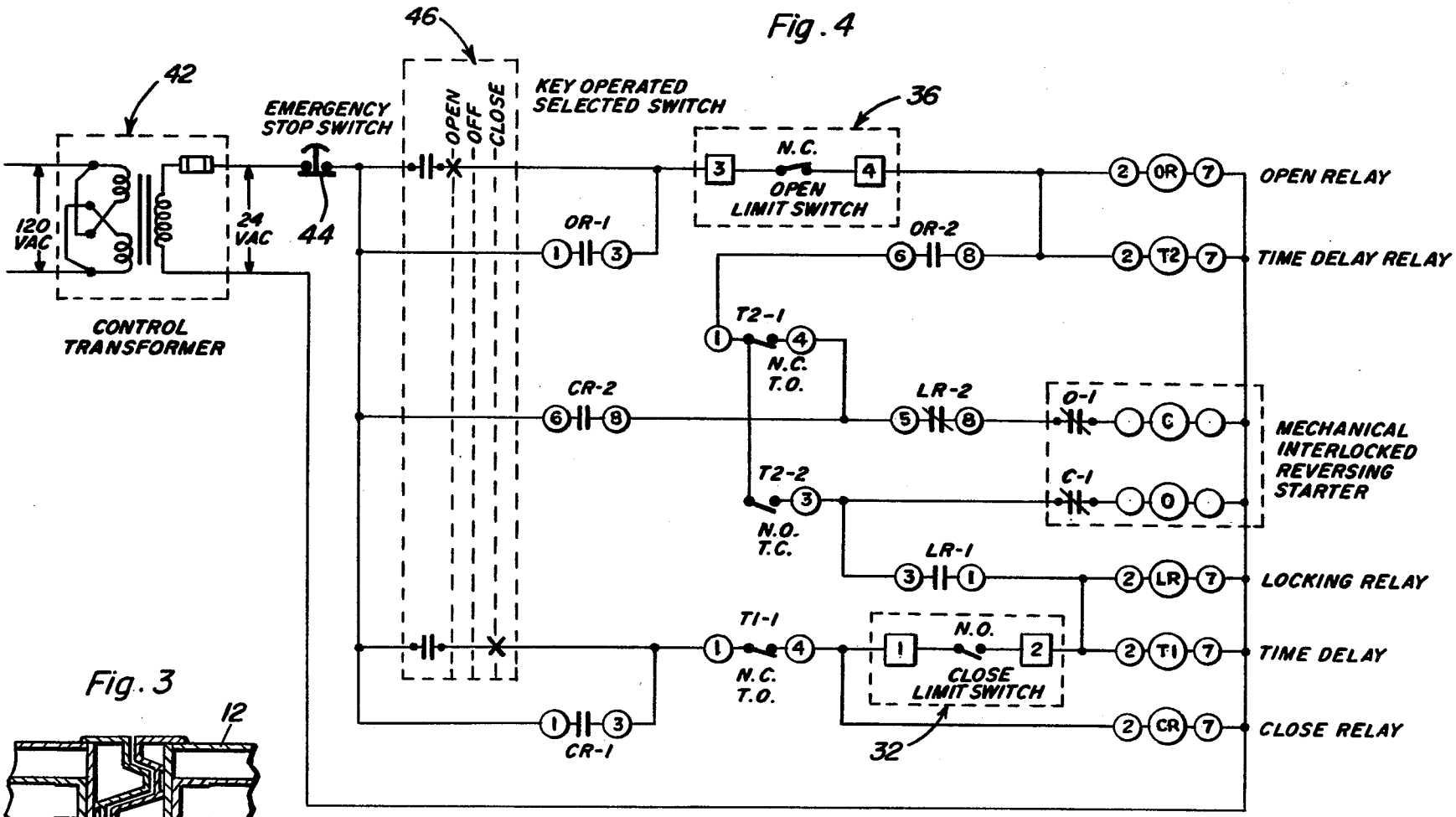
FIG. 4 is a diagrammatic view of the control system for the folding partition.

As illustrated in FIG. 4, power is supplied to the system through a conventional transformer generally designated by numeral 42 through an emergency stop switch 44 to a key operated selector switch 46, which can be turned in a counterclockwise direction to the "open" position or a clockwise direction to the "close" position. To briefly describe the opening operation illustrated in FIGS. 1*a*–1*d*, turning the key operated selector switch 46 counterclockwise to the "open" position energizes open relay "OR" and time delay relay "T2" with the open relay "OR" being locked in by closing of contact "OR-1". "Close" contactor is energized with the closing of contact "OR-2" through the normally closed, timed-to-open contacts "T2-1" and "LR-2" and through the normally closed interlock and the motor will be operated in the "close" direction. At the end of the time setting of time delay relay "T2", the normally-closed, timed to open contact "T2-1" opens breaking the circuit to the "close" contactor and deenergizing the motor. At the same time, the normally open, timed-to-close contact "T2-2" closes, completing the circuit to the "open" contactor, through the normally closed interlock and the motor reverses and runs in the "open" direction. When the partition reaches the end of its travel, the "open" limit switch 36, which is normally closed, is opened, breaking the circuit and deenergizing open relay "OR", time delay relay "T2" and "open" contactor. The motor stops and the partition is in the fully "open" position.

Thus, upon operation of the switch to "open" position, the partition is driven in the "close" direction from the position of FIG. 1*a* for a predetermined set short amount of time which causes with the closing of contact "CR-2" through normally closed contact "CR-2" through normally closed contact "LR-2" and through normally closed innerlock which starts the motor in the direction to close the partition. When the partition reaches the end of the travel, the "closed limit switch" which is normally open is closed and time delay relay "T1" and locking relay "LR" are both energized. Contact "LR-2" opens thus deenergizing the "close" contactor and contact "LR-1" closes, energizing the "open" contactor so that the motor then reverses and runs in the "open" direction. At the end of the time setting of time delay relay "T1", the normally-closed, timed-to-open contact "T1-1" opens, breaking the circuit and deenergizing close relay "CR", locking relay "LR", time delay relay "T1" and the "open" contactor so that the motor stops and the partition is in the locked closed position.

Figures 2A, 2B, 2C, 2D:
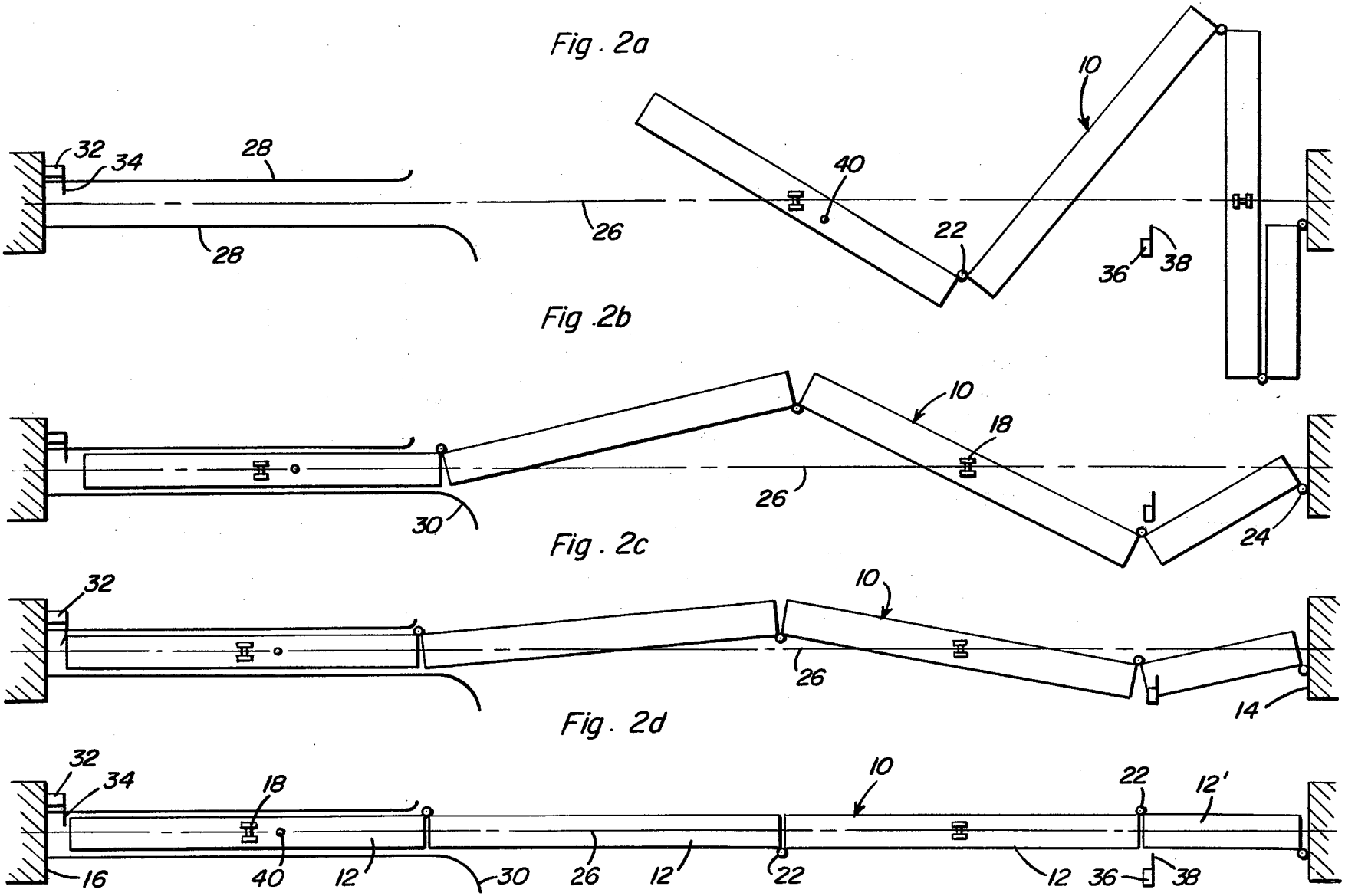
FIGS. 2*a*–2*d* schematically illustrate the movement of the panels from their open position to their fully closed position.
Figure 3:
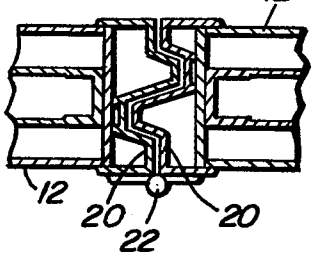
FIG. 3 is a fragmental sectional view of a typical hinge connection between adjacent panels.

Thus, from the position illustrated in FIG. 2*a*, the partition is electrically driven forward which causes the panels 12 to unstack as shown and the forward panel enters the guides and approaches the sensor. When the outermost panel is almost straight, contact with the sensor is made and the sensor reverses movement of the outermost panel which causes the partition to lock all of the panels in a straight position with the momentum and inertia of the panels as the hinge axes 22 approaches the center line 26 carrying the hinge axes across the center line 26 which together with the reversing of the motor for a short period of time enables the partition to, in effect, slightly shorten so that the panels will be retained in their straight line, fully open position.

Thus, from the position illustrated in FIG. 2*a*, the partition is electrically driven forward which causes the panels 12 to unstack as shown and the forward panel enters the guides and approaches the sensor 32. When the endmost panel is almost straight, contact with the sensor is made and the sensor reverses movement of the endmost panel which causes the partition to lock all of the panels in a straight position with the momentum and inertia of the panels as the hinge axes 22 approach the center line 26 carrying the hinge axes across the center line 26 which together with the reversing of the motor for a short period of time enables the partition to, in effect, slightly shorten so that the panels will be retained in their straight line, fully closed position.

This arrangement eliminates the necessity of imparting lateral force to the folding partition or panels when moving from a fully closed to an open position and eliminates the necessity of imparting lateral forces to the partition or panels when moving from the open position to the fully closed position, as compared with prior devices which use a secondary apparatus which applies lateral force to an endmost panel or panels.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In an electrically operated folding partition comprising a plurality of rigid panels having the vertical edges thereof pivotally connected with some or all of the panels being supported from a longitudinal trackway by carriages, said panels having substantial thickness and being disposed in a flat, straight line condition when the partition is in fully closed position and being stacked in accordion folded condition when the partition is in fully open position with the hinge axes of the pivotal connection between adjacent panels being disposed at or near opposite surfaces of the partition when the partition is fully closed, that improvement comprising control means for opening and closing the partition by applying a closing force to the partition for initially extending the partition to a length greater than the over-all length thereof when fully closed, thereby moving the hinge axes toward the longitudinal center line of the partition and reversing the direction of force to an opening force applied to the partition as the hinge axes cross over the center line due to inertia of the panels with continued opening force exerted on the partition moving the panels to their fully open or closed position.

2. The structure as defined in claim 1 wherein said control means moves the panels to their open position by exerting closing force on the closed partition to move the hinge axes toward the center line of the partition with inertial force causing the hinge axes to cross over the center line, said control means then reversing the force to an opening force to move the panels to an accordion folded open position.

3. The structure as defined in claim 1 wherein said control means moves the panels to their closed position by exerting closing force on the partition until the hinge axes approach and cross over the center line of the partition due to inertia with the control means then reversing the force to an opening force for a short predetermined time period permitting the panels to assume a straight aligned condition.

4. The structure as defined in claim 1, wherein said control means includes a sensing device including means to reverse the direction of force exerted on the partition when the partition moves to a position with the hinge axes in a straight line generally coincident with the center line of the partition with the reversing of the force being quite rapid to enable inertia to carry the hinge axes across the center line of the partition.

5. The structure as defined in claim 1 wherein said control means includes a timing device including means to reverse the direction of force exerted on the partition when the partition moves to a position with the hinge axes in a straight line generally coincident with the center line of the partition with the reversing of the force being quite rapid to enable inertia to carry the hinge axes across the center line of the partition.

6. In a power operated folding partition comprising a plurality of rigid panels having their vertical edges hingedly connected with the hinge axes being spaced laterally from the center line of the panels and alternately on opposite sides of the center line for accordion folding movement between open and closed position with the panels being in straight, aligned position when fully closed with the hinge axes moving across the center line when the panels move to and from their fully closed position, that improvement comprising means applying longitudinal forces only to said partition to move said panels to and from their fully closed position.

7. The structure as defined in claim 6 wherein said partition is moved from closed position toward open position by said means applying longitudinal closing force to said partition for a short time period for lengthening the partition and moving the hinge axes toward the center line with inertial force carrying the hinge axes across the center line as the panels move into a shallow accordion folded position, said means then applying an opening force to the partition to continue the folding movement of the panels toward an accordian folded stacked fully open position.

8. The structure as defined in claim 6 wherein said partition is moved from open position toward closed position by said means applying longitudinal closing force to said partition to move said hinge axes toward the center line with inertial force carrying the hinge axes across the center line, said means then applying an opening force to the partition for a short time interval permitting the panels to assume a straight, aligned fully closed position.

9. A folding partition supported from a longitudinal trackway and including a plurality of rigid panels pivotally interconnected along vertical edge portions for movement of the partition between a closed position in which the panels are in alignment to form a substantially flat wall and an open position in which the panels are in stacked accordion folded position, said panels having substantial thickness with the hinge axes between adjacent pairs of panels being on or near opposed surfaces of the panels when in a closed position whereby the hinge axes are spaced laterally from the center line of the partition when closed, means for opening and closing the partition by moving the panels in the extended direction to cause the panels to pivot in relation to each other as the hinge axes approach alignment with the center line and reversely moving the panels as the hinge axes cross the center line due to inertia, thereby enabling the panels to continue to their fully open or their fully closed position.

10. The structure as defined in claim 9 wherein said means moving the panels moves them from a stacked open position to a shallow accordion folded position with the hinge axes approaching the center line and inertial force carrying the hinge axes across the center line, said means then moving the panels in an opening direction for a short period of time to enable the panels to assume an aligned position to form a flat wall by exerting only longitudinal forces on the partition.

11. The structure as defined in claim 9 wherein said means moving the panels moves them from an aligned closed position in a closing direction to a shallow accordion folded position with the hinge axes approaching the center line and inertial force carrying the hinge axes across the center line, said means then moving the panels in an opening direction to their fully open position by exerting only longitudinal forces on the partition.

12. The structure as defined in claim 9, wherein the adjacent edges of the panels have abutting surfaces with the thickness of the panels together with the relationship of the hinge axes and suspension of the panels from an overhead trackway along the center line of the panels causing the panels to be in locked condition when in a straight line position.

13. The structure as defined in claim 9, wherein said means moving the panels includes electrically operated means with position and/or time control means operatively associated with the partition for activation when the partition is adjacent its fully closed or fully open position, said control means activated when the partition is adjacent its fully closed position including reversing means to reverse application of force to the partition to move the hinge axes toward the center line with inertia carrying the hinge axes across the center line and reverse force moving the hinge axes away from the center line after crossing over.

14. The structure as defined in claim 12, wherein said means moving the panels includes electrically operated means with position and/or time control means operatively associated with the partition for activation when the partition is adjacent its fully closed or fully open position, said control means activated when the partition is adjacent its fully closed position including reversing means to reverse application of force to the partition to move the hinge axes toward the center line with inertia carrying the hinge axes across the center line and reverse force moving the hinge axes away from the center line after crossing over.

15. The structure as defined in claim 13 wherein said control means activated when the partition in adjacent its fully open position including switch means to stop the partition in its fully open position.

* * * * *

UNITED STATES PATENT OFFICE
CERTIFICATE OF CORRECTION

PATENT NO. : 4,106,544

DATED : August 15, 1978

INVENTOR(S) : Guy E. Dixon and Thomas M. Dixon

It is certified that error appears in the above-identified patent and that said Letters Patent are hereby corrected as shown below:

In the Abstract, front page, column 2, line 7 after "being" insert --alternately--;

line 9, cancel "with" insert --. When moving the panels from their closed position to their open position,--;

line 11, cancel "being" insert --is--;

line 12, after "their" insert --closed--; same line, cancel ", straight line";

line 13, cancel "in" insert --falling along--;

line 15, cancel "inertia" insert --inertial--; same line, cancel "causing" insert --cause--;

line 17, after "panels" insert --from open--;

line 18, cancel "outermost" insert --endmost--;

line 22, cancel "outermost" insert --endmost--.

Column 1, line 35, after "operated" insert --partitions in which the endmost panel is power operated--;

line 36, cancel "the adjacent" insert --some or all of the--;

line 43, cancel "initially"; same line, after "move" insert --some or all of--;

line 47, after "be" insert --move to the--; same line, after "folded", cancel "to";

line 61, cancel "center";

UNITED STATES PATENT OFFICE
CERTIFICATE OF CORRECTION

PATENT NO. : 4,106,544

DATED : August 15, 1978

INVENTOR(S) : Guy E. Dixon and Thomas M. Dixon

It is certified that error appears in the above-identified patent and that said Letters Patent are hereby corrected as shown below:

Column 2, line 5, cancel "cen-";
line 6, cancel "ter"; same line, after "open" (first occurrence) insert --accordion folded--;

line 37, cancel "outermost" insert --endmost--;
line 47, cancel "end" insert --side--;

Column 5, line 9, after "causes" insert --the panels of the partition to break from their straight line as illustrated in Fig. 1a with the hinge axes crossing over the center line by inertia as the hinge axes move from their position illustrated in Fig. 1a toward the center line as the partition is extended from the panels being in a flat, straight line position toward the extended position, the endmost panel 12 being moved to the left. As the hinge axes move across the center line, reversing of the direction of the endmost panel 12 provides reverse movement of the endmost panel 12 to continue the break of the panels toward the accordion folded, stacked open position.

With the partition in open position and turning the key operated selector switch 46 to the "close" position, the close relay "CR" will be energized with this relay being locked in by closing of contact "CR-1". "Close" contactor is energized--;

line 10, cancel "through normally closed contact "CR-2";
line 14, cancel "closed" insert --close--; same line, after "switch" insert --32--;
lines 27-40, cancel in their entirety;

UNITED STATES PATENT OFFICE

CERTIFICATE OF CORRECTION

Patent No. 4,106,544 Dated August 15, 1978

Inventor(s) Guy E. Dixon and Thomas M. Dixon

It is certified that error appears in the above-identified patent and that said Letters Patent are hereby corrected as shown below:

Column 8, line 44, cancel "in" insert --is--.

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*